US005884823A

United States Patent [19]

Carroll

[11] Patent Number: 5,884,823

[45] Date of Patent: Mar. 23, 1999

[54] COLLAPSIBLE SHOE HORN

[75] Inventor: Richard A. Carroll, Cranston, R.I.

[73] Assignee: The Lorac Company, Inc., Providence, R.I.

[21] Appl. No.: 84,833

[22] Filed: May 26, 1998

[51] Int. Cl.[6] ..... A47G 25/82

[52] U.S. Cl. ..... 223/118

[58] Field of Search ..... 223/118, 119

[56] References Cited

U.S. PATENT DOCUMENTS

| | | | |
|---|---|---|---|
| D. 140,140 | 1/1945 | Forman . | |
| 655,417 | 8/1900 | Randall . | |
| 1,213,948 | 1/1917 | Redheffer . | |
| 1,242,615 | 10/1917 | Sommer . | |
| 1,408,318 | 2/1922 | Walter . | |
| 1,423,422 | 7/1922 | Harms | 223/119 |
| 1,573,729 | 2/1926 | Martin . | |
| 1,766,374 | 6/1930 | Byrd . | |
| 3,788,531 | 1/1974 | Oldfield . | |

*Primary Examiner*—Bibhu Mohanty
*Attorney, Agent, or Firm*—Salter & Michaelson

[57] ABSTRACT

A collapsible shoe horn includes a shoe horn tongue having a generally thin and smooth body portion for aiding the user in putting on a pair of shoes. The side edges of the shoe horn tongue are slightly curved upwardly in a concave manner so that the shoe horn tongue conforms to the shape of the heel of a human foot. A neck portion is integral with and extends from the bottom of the shoe horn tongue. The neck portion has a pair of opposing flanges, each flange having a dap opening formed within the interior side thereof for receiving opposing ends of a shoe horn handle. The dap openings have a smooth dimple-like dap surface extending from the outer exposed surface of each neck flange for protecting the shoe horn user from the sharp ends of the shoe horn handle.

3 Claims, 2 Drawing Sheets

COLLAPSIBLE SHOE HORN

BACKGROUND AND SUMMARY OF INVENTION

This invention relates generally to shoe paraphernalia, and more particularly to a collapsible shoe horn having a wire-like shoe horn handle pivotally connected to a shoe horn tongue. The handle is movable between a first open and extended position wherein the shoe horn is operable for more easily sliding a shoe onto a person's foot and a second closed and collapsed position wherein the wire shoe horn handle is folded adjacent the shoe horn tongue for easy transportation of the shoe horn from one place to another. The invention is directed to a pair of daps formed in the outer exposed surface of opposing flanges of the shoe horn neck which provide a protective covering for the free ends of the shoe horn handle, which previously extended outwardly from open apertures in the neck flanges and presented dangerously sharp edges when the shoe horn was in use, or was being transported.

For convenience, shoe horns were created many years ago to aid the average person in putting on a pair of shoes. Shoe horns are most often used with dress shoes or the like as opposed to a pair of sneakers which are traditionally easier to fit over the human foot. Traditionally, shoe horns help to eliminate the action of having to fit the human heel over the rigid heel portion of a shoe. Often times, without the aid of a shoe horn, the top edge of the rear portion of the shoe will turn under the person's foot when inserting same inside the shoe structure which results in uncomfortable fitting of the shoe as well as unnecessary bending and wear and tear of the rear portion of the shoe. In order to effectively put on a pair of dress shoes, the use of a shoe horn is practically mandatory. The instant invention relates to a collapsible shoe horn that may be easily folded and carried in a persons pocket when the shoe horn is not in use, but may also be easily unfolded and used to aid the user in putting on a pair of shoes. The shoe horn of the present invention has a pair of protective daps which cover the wire ends of the shoe horn handle so that the sharp edges thereof are not exposed.

Collapsible shoe horns and the like have heretofore been known in the prior art. In this regard, U.S. Pat. No. 655,417 issued to E. J. Randall, U.S. Pat. No. 1,213,948 issued to C. R. Redheffer, and U.S. Pat. No. 1,242,615 issued J. L Sommer are the closest prior art to the subject matter of the instant invention to which the applicant is aware. The Randall patent shows a shoe horn device that is secured to the heel portion of the sole of the shoe. The device further includes a supporting bail which is secured to the rear portion of the shoe so that it does not bend under the heel of the foot when inserting same into the interior of the shoe structure. The Redheffer patent shows a collapsible shoe horn having a hinge mechanism which extends across the width of the shoe horn body and allows the shoe horn to be movable between an open and operable position and a closed and folded position. The device further includes a locking tab which catches the front edge of the shoe horn tongue and maintains same in the closed and folded position when the device is not in use. The Sommer patent shows yet another type of collapsible shoe horn wherein the handle portion of the device is pivotal around a hinge pin and may have any number of different utility functions, i.e., a button hook as shown in the preferred embodiment. However, none of the above-discussed patents show a collapsible shoe horn as disclosed in the instant invention having a pair of daps for protecting the shoe horn user from the sharp edges of the outwardly extending shoe horn handle.

The instant invention is directed to a collapsible shoe horn which is operable for more easily fitting a shoe on a human foot. The shoe horn includes a tongue portion of metallic construction having a generally thin and flattened body wherein the body is curved upwardly in a concave manner to conform to the shape of the human heel for sliding the heel down the body of the tongue and into a shoe structure. The shoe horn further includes an integral neck portion which extends downwardly from the bottom of the shoe horn tongue and has a pair of opposing flanges having a pair of dapped openings formed therein for receiving opposing ends of a wire shoe horn handle. The dap openings have a smooth dimple-like surface extending from the outer exposed surface of the neck flanges for protecting the shoe horn user from the sharp ends of the shoe horn handle wire. The shoe horn handle is pivotal within the dap openings between a first extended and operable position and a second closed and folded position.

Accordingly, among the several objects of the instant invention are: the provision of a collapsible shoe horn having a shoe horn handle that is pivotal between an extended and operable position and a folded and inoperable position; the provision of a collapsible shoe horn wherein said shoe horn handle is pivotal within a pair of opposing dap openings; the provision of a collapsible shoe horn having a pair of protective dimple-like dap covers which protect the user from the sharp end edges of the shoe horn wire handle; the provision of a collapsible shoe horn that is neat and attractive in appearance; the provision of a collapsible shoe horn that is simple and easy to use; and the provision of a collapsible shoe horn that is cost efficient and easy to manufacture.

Other objects, features and advantages of the invention shall become apparent as the description thereof proceeds when considered in connection with the accompanying illustrative drawings.

BRIEF DESCRIPTION OF THE DRAWING

In the drawings which illustrate the best mode presently contemplated for carrying out the present invention.

DETAILED DESCRIPTION OF THE PREFERRED EMBODIMENT

Figure 1:
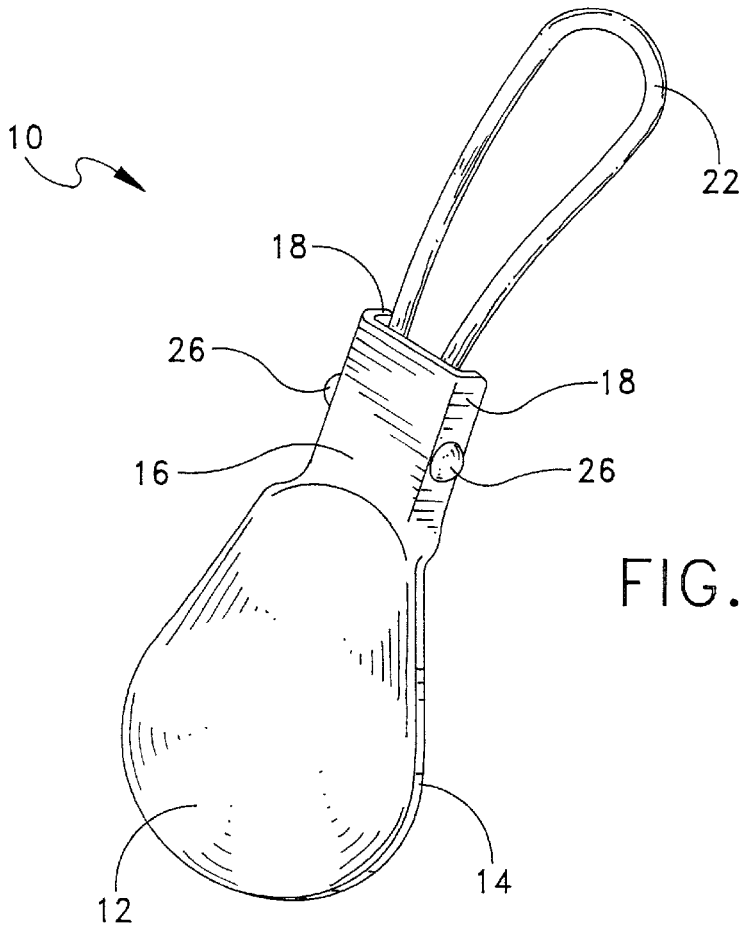
FIG. 1 is a perspective view of the collapsible shoe horn of the instant invention showing the shoe horn in an open and operable position.

Referring now to the drawings, and more particularly to FIG. 1, the collapsible shoe horn of the instant invention is shown and generally indicated at 10. As will hereinafter be more fully described, the instant invention provides for a collapsible shoe horn that is movable between a first extended and operable position for more easily fitting a shoe over the heel of a human foot, and a second folded and portable position wherein the shoe horn may be easily carried in the user's pocket. The shoe horn handle which is an elongated formed wire, is pivotally mounted within a pair of dap openings, the dap openings having a smooth dimple-like exposed surface protecting the user from the sharp end edges of the shoe horn handle wire.

Figure 2:
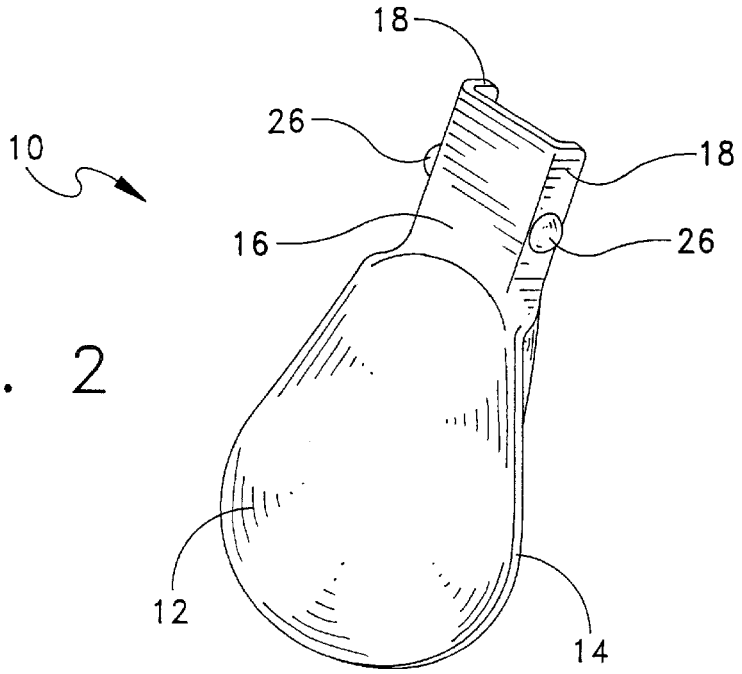
FIG. 2 is a perspective view of the collapsible shoe horn of the instant invention showing the shoe horn in a closed and collapsed position.

Referring now to FIGS. 1 & 2, the collapsible shoe horn of the instant invention 10 is shown in both the extended operable position and the collapsed folded position. The shoe horn includes a tongue portion preferably of metallic construction generally indicated at 12. The tongue portion has a smooth and thin uniform body wherein the side edges 14 of the body are slightly curved upwardly so that the tongue 12 takes on a slightly concave shape for more easily conforming to the shape of the human heel. The tongue 12 of the shoe horn 10 is used in a conventional manner wherein the heel of the human foot slides down the concave body of the tongue and into the interior of the selected shoe. The shoe horn further includes a neck portion 16 which is integral with and extends from the bottom of the shoe horn tongue 12. The neck portion 16 has a pair of oppositely disposed flanges 18 each having a dap opening 20 formed within the interior of each flange 18. The arrangement is such that the dap openings 20 provide pivot points for a wire-like shoe horn handle 22, the ends of which are received within the corresponding dap openings 20. As will be noted in FIG. 4, the wire handle 22 is of an elongated unshaped configuration terminating in outwardly extending ends or pintles 24.

Figure 3:
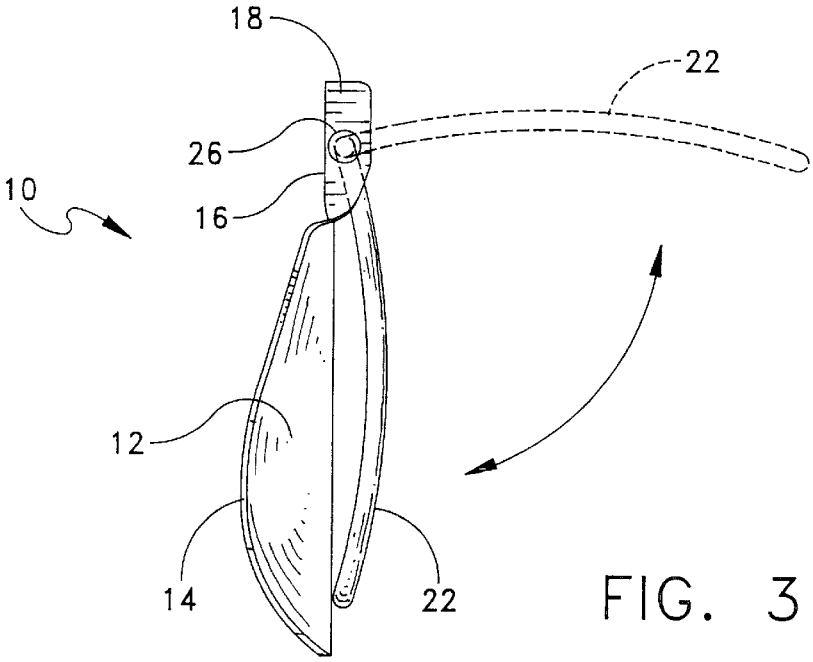
FIG. 3 is a side view of the collapsible shoe horn of the instant invention showing the pivotal nature of the shoe horn handle between the open and closed positions.
Figure 4:
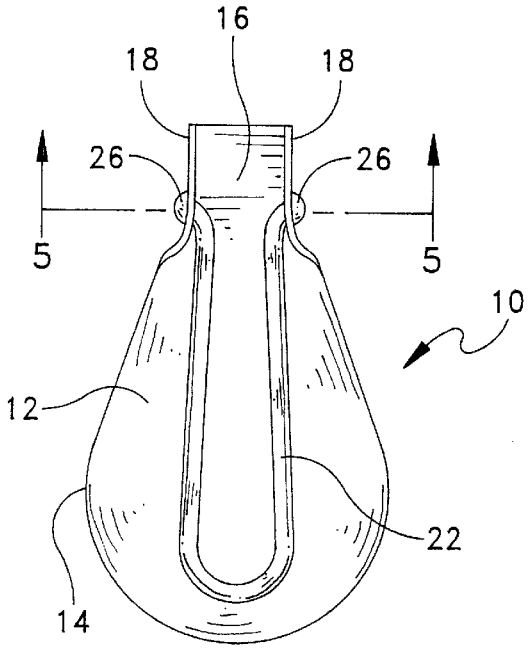
FIG. 4 is a rear view of the collapsible shoe horn of the instant invention showing the shoe horn handle in the closed and collapsed position.
Figure 5:
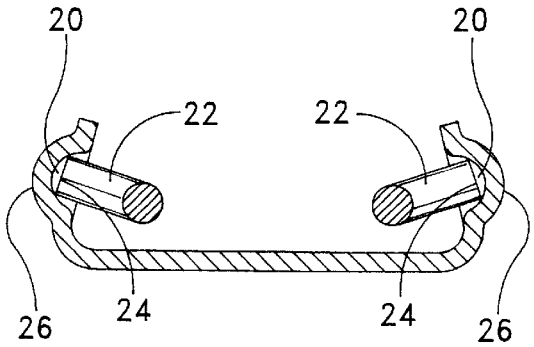
FIG. 5 is a cross-sectional view taken along line 5—5 of FIG. 4.

Referring now to FIGS. 3–5, the pivotal arrangement of the shoe horn handle 22 is more clearly depicted. Specifically, the shoe horn handle 22, which is preferably of metallic wire, is pivotal between a first open and extended position as shown in FIG. 1, and a second closed and folded position as shown in FIG. 2. The ends 24 of the shoe horn handle 22 are received within the dap openings 20 of opposing flanges 18 wherein the ends of the handle pivot within the dap openings so that the handle 20 may be moved to the desirable position. The invention is directed to the smooth dimple-like dap surfaces 26 located at the outer exposed side of the neck flanges 18 which protect the user from the sharp end edges of the shoe horn wire handle 22.

In use, the shoe horn handle 22 is pivoted away from the body of the shoe horn tongue 12 so that it extends outwardly therefrom in the same general plane thereof. A portion of the shoe horn handle 22 engages the neck portion 16 when the shoe horn is moved to the open and operable position to limit the opening movement thereof. At this point, the tongue 12 is inserted in the rear portion of the selected shoe and the person's foot is then forced into the shoe so that the heel portion of the foot engages the smooth concave surface of the tongue and slides theredown into the rear of the shoe. The shoe horn 10 may then be pulled outwardly from between the rear of the person's foot and the shoe. The handle 22 of the shoe horn 10 is then folded to the closed position of FIGS. 2 and 4, so that the handle 22 is adjacent the convex side of the shoe horn tongue 12. The shoe horn 10 may then be inserted in the user's pocket and conveniently and safely carried from one place to another. If the daps 26 were not present, and the ends 24 of wire handle 22 simply extended through apertures in the flanges 18, the sharp edges of the wire ends could possible tear the user's pocket, or worse yet, possibly cut the user's hand during use and manipulation of the shoe horn.

It can therefore be seen that the instant invention provides for a portable shoe horn that effectively aids the user in putting on a pair of shoes. The shoe horn is easily folded to a portable non-operable position wherein the shoe horn may be carried within a person's pocket for transportation from one place to another. Specifically, the shoe horn includes a pair of smooth dimple-like protective dap covers which protect the user from the sharp end edges of the wire shoe horn handle. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described except insofar as indicated by the scope of the appended claims.

What is claimed is:

1. A collapsible shoe horn comprising:

a shoe horn tongue having a generally thin and flattened body wherein the side edges of the body are slightly curved upwardly in a concave manner to conform to the shape of the human heel for more easily putting a shoe on a human foot;

an integral neck portion extending downwardly from the bottom of the shoe horn tongue, said neck portion having a supporting wall and a pair of opposing flanges integral with said supporting wall and extending in an opposite direction than said upwardly curved side edges of said tongue;

a shoe horn handle having a pair of opposed, outwardly extending pintles; and a pair or opposed dapped openings in said flanges, said dapped openings receiving said pintles therein whereby said handle may be pivoted with respect to said tongue between a first extended and operable position wherein said handle engages said supporting wall, and a second collapsed and inoperable position wherein said handle engages the convex side of said tongue.

2. A collapsible shoe horn as set forth in claim 1, wherein said handle is an elongated u-shaped wire, the free ends of which extend outwardly to form said pintles.

3. A collapsible shoe horn as set forth in claim 2, wherein said tongue and said wire handle are both of metallic construction.

* * * * *